US008157479B2

(12) United States Patent
Sullivan

(10) Patent No.: US 8,157,479 B2
(45) **Date of Patent: *Apr. 17, 2012**

(54) LOW PROFILE BUOYANCY ADJUSTMENT CONTROLLER AND VALVE SYSTEM FOR DIVER'S VEST

(75) Inventor: David B. Sullivan, Escondido, CA (US)

(73) Assignee: Aqua Lung America, Inc., Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/083,175

(22) Filed: Apr. 8, 2011

(65) Prior Publication Data

US 2011/0180162 A1 Jul. 28, 2011

Related U.S. Application Data

(62) Division of application No. 11/741,982, filed on Apr. 30, 2007, now Pat. No. 7,922,422.

(51) Int. Cl.
*B63C 11/08* (2006.01)

(52) U.S. Cl. ..... 405/186; 441/96

(58) Field of Classification Search ..... 405/186, 405/187; 441/88, 90, 92, 94, 96
See application file for complete search history.

(56) References Cited

U.S. PATENT DOCUMENTS 3,436,777 A * 4/1969 Greenwood ..... 405/186
3,866,253 A * 2/1975 Sinks et al. ..... 405/186
4,000,534 A * 1/1977 Cerniway et al. ..... 405/186
4,137,585 A * 2/1979 Wright, III ..... 405/193
4,379,656 A * 4/1983 Darling ..... 405/186
4,720,281 A * 1/1988 Matsuoka ..... 405/186
4,779,554 A * 10/1988 Courtney ..... 405/186
4,810,134 A * 3/1989 Eaulconer et al. ..... 405/186
4,913,589 A * 4/1990 Faulconer et al. ..... 405/186
5,505,559 A * 4/1996 Hermansen ..... 405/186
7,922,422 B2 * 4/2011 Sullivan ..... 405/96
2001/0036781 A1 * 11/2001 Cressi ..... 405/186
2002/0057946 A1 * 5/2002 Beltrani ..... 405/186

* cited by examiner

*Primary Examiner* — Frederic L Lagman
(74) *Attorney, Agent, or Firm* — Venable, Campillo, Logan & Meaney, P.C.

(57) ABSTRACT

A buoyancy adjustment device utilizes an inflation valve connected between the diver's breathing gas supply and a compartment to admit gas into the compartment to increase the diver's buoyancy. An exhaust valve connects between the compartment and the outside of the vest, to release gas from the compartment to the surrounding environment to decrease the diver's buoyancy. A hand-operated controller connected to the inflation valve, when caused to move from a neutral position to an inflation position, actuates the inflation valve and admits gas to the compartment. The hand-operated controller is also connected to the exhaust valve via a flexible pushrod so that, when caused to move from the neutral position to an exhaust position, actuates the exhaust valve and releases gas from the compartment. The flexible push rod is housed in a sleeve that is totally contained within the compartment. Both the inflation valve and the exhaust valve are mounted substantially within the compartment, below the outer wall of the diver's vest and their respective working parts leave only a low profile raised above the outside surface of the vest. A cloth sleeve is positioned inside the front portion of the vest to conveniently store a spare breathing regulator.

11 Claims, 8 Drawing Sheets

LOW PROFILE BUOYANCY ADJUSTMENT CONTROLLER AND VALVE SYSTEM FOR DIVER'S VEST

This application is a divisional of prior application Ser. No. 11/741,982 filed Apr. 30, 2007, now issued U.S. Pat. No. 7,922,422 which is herein incorporated by reference.

FIELD OF THE INVENTION

This invention pertains to a vest, generally known as a buoyancy compensation vest that is used by divers with self-contained underwater breathing apparatuses (SCUBA) and related equipment.

BACKGROUND OF THE INVENTION

As a diver descends under water, his/her overall buoyancy is determined by the relationship between overall body and equipment weight and the weight of the water displaced. If the diver and equipment is heavier than the water they displace, the diver sinks. If the diver and equipment is lighter than the water they displace, the diver floats. While underwater, the diver inhales compressed gas from a tank and exhales into the surrounding environment, thus removing the weight of this used air from the diver's overall weight and changing the diver's buoyancy. In order to remain at a give underwater depth, it is desirable that the diver have some means of maintaining buoyancy.

Early buoyancy compensation devices used lead weights hung on a belt about the waist that could be cast off when no longer needed, i.e., as the diver became lighter due to utilization of air. Lead weight belts allowed buoyancy to be adjusted in increments that may or may not be practical. Later advances introduced the use of a vest, worn by the diver, on which various weights, tools, and the like could be hung. Later models of diving vests use air-tight compartments built into the vest, which may be orally inflated by the diver and later adjusted through gas released from the compartment to provide closer control over buoyancy.

These prior art devices require attention by the diver and use of fingers in removing weights, pulling out a tube to orally inflate the vest, and adjusting valves to release gas from the vest. Recently, efforts have been made to simplify and semi-automate the compartment inflation/deflation process. Gas valves are inserted in the gas breathing line to allow inflating of the compartment by operating an inflation valve or button and deflating the compartment by operating an exhaust valve or button (to exhaust gas to the surrounding environment) and grouping these valves and buttons in one place for use by the fingers of one hand. U.S. patents such as U.S. Pat. Nos. 3,487,647; 3,727,250; 4,054,132; 4,068,657; 4,523,914; 4,529,333; 4,681,552; 4,779,554; 4,913,589; and 5,256,094 are examples of recent prior art disclosing inventions that attempt to improve the operation of what are now known as "buoyancy compensation" vests. While some of these inventions have proved somewhat useful, they have not solved problems encountered in more aggressive diving environments.

For instance, divers are now diving deeper where the water is colder and where the light level is substantially lower. In addition, divers are exploring more old sunken vessels, narrower caves, and heavier vegetation. Less light and colder temperatures mean more difficulty in finding the exact button to press to make the vest lighter or heavier. Cold temperatures in particular make it difficult to use fingers to manipulate the buttons. Entering more sunken vessels and encountering heavier vegetation means more chances of snagging the vest on some extraneous element, be it an old cable, an abandoned rope or hawser, or on a thick root or branch.

Prior art buoyancy vests, such as the one shown in U.S. Pat. No. 5,256,094, display a sheathed cable running outside the buoyancy vest, from the side of the vest rearward and upward to the rear of the shoulder area. This is a very important cable and could cause the diver serious problems if it is caught on some projection on the sunken vessel, or on a root or branch. In the same patent, the vest exhaust valve is in the form of a rather large lump located high on the rear shoulder of the vest that provides a collision danger with extraneous elements in close proximity to the vest. FIG. 1 shows another exemplary prior art buoyancy compensation vest. A bulky inflation apparatus has manual inflator 2, inflation controller button 6, deflation controller 4 attached to high-profile inflator connection 10 above left should panel 9. Deflation valve 44 above right shoulder panel 9 also has a high profile.

As buoyancy compensation vests become more developed and more sophisticated, new devices are implemented to adjust the buoyancy. Some manufacturers have removed time-tested manual overrides that provide a measure of safety and protection to the diver. A need exists for a simplified method for manipulating inflation valves and deflation valves on buoyancy compensation vests under extreme conditions, while still utilizing known safety measures. The inflation valves, deflation valves and associated controls should have a sleek, low profile that is less susceptible to snagging and improves the aesthetic appearance of the diving vest.

SUMMARY OF THE INVENTION

A buoyancy adjustment device utilizes an inflation valve connected between the diver's breathing gas supply and a compartment to admit gas into the compartment to increase the diver's buoyancy. An exhaust valve connects between the compartment and the outside of the vest, to release gas from the compartment to the surrounding environment to decrease the diver's buoyancy. A hand-operated controller connected to the inflation valve, when caused to move from a neutral position to an inflation position, actuates the inflation valve and admits gas to the compartment. The hand-operated controller is also connected to the exhaust valve so that, when caused to move from the neutral position to an exhaust position, actuates the exhaust valve and releases gas from the compartment. The controller is connected to the exhaust valve by a flexible push rod. The flexible push rod is housed in a sleeve that is totally contained within the compartment. The flexible push rod is only subject to compression loads during operation. The controller selectively operates the valves by movement from the neutral position to the inflation position, or from the neutral position to the exhaust position. Both the inflation valve and the exhaust valve are mounted substantially within the compartment, below the outer wall of the diver's vest and their respective working parts leave only a low profile raised above the outside surface of the vest. A lanyard extends from the exhaust valve outside the vest to operate as a safety valve to release gas and decrease buoyancy of the diver. A cloth sleeve is positioned inside the front portion of the vest to conveniently store a spare breathing regulator.

DETAILED DESCRIPTION OF THE INVENTION

Figure 1:
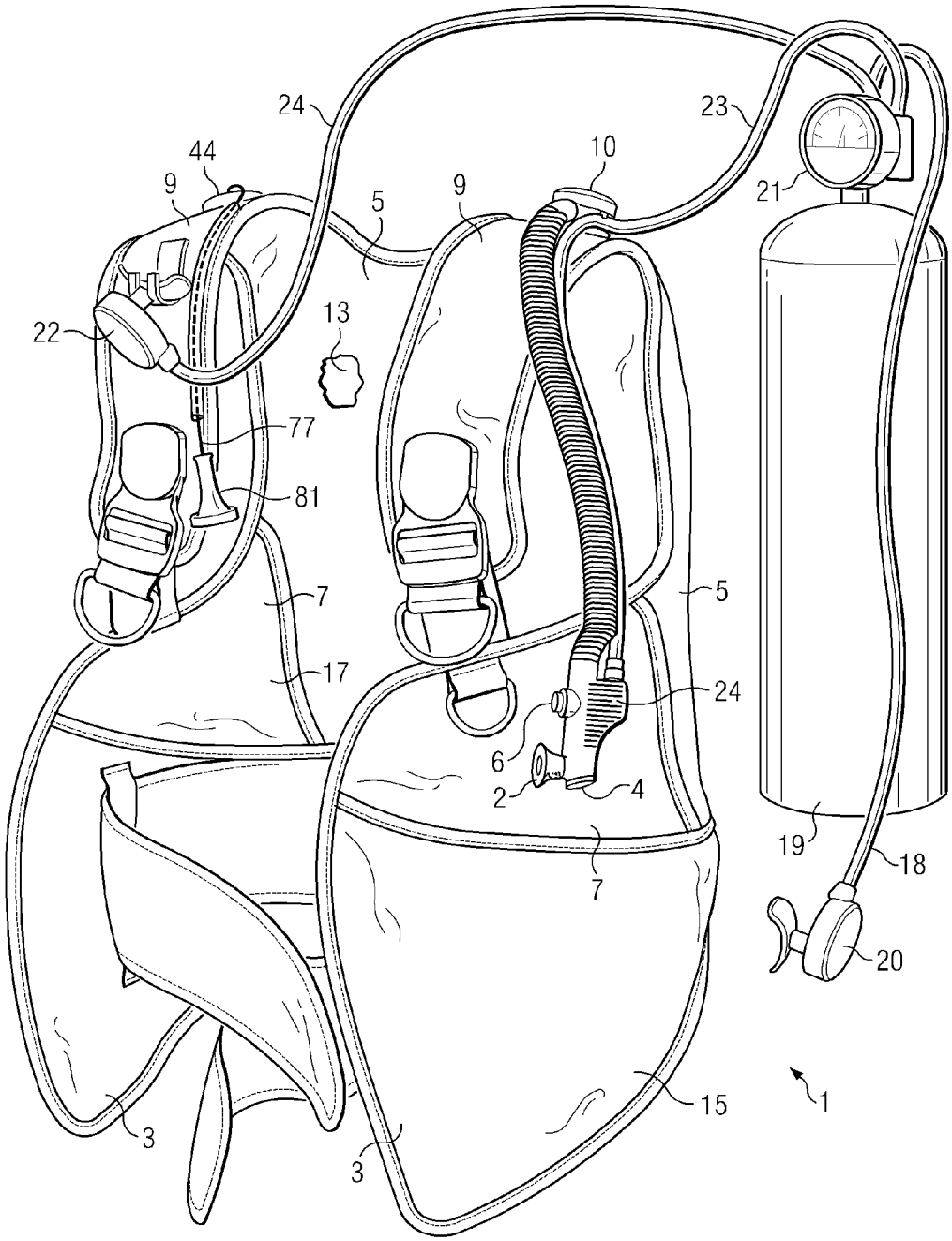
FIG. 1 (PRIOR ART)
FIG. 1 is a perspective view of a prior art buoyancy compensation vest.
Figure 2A:
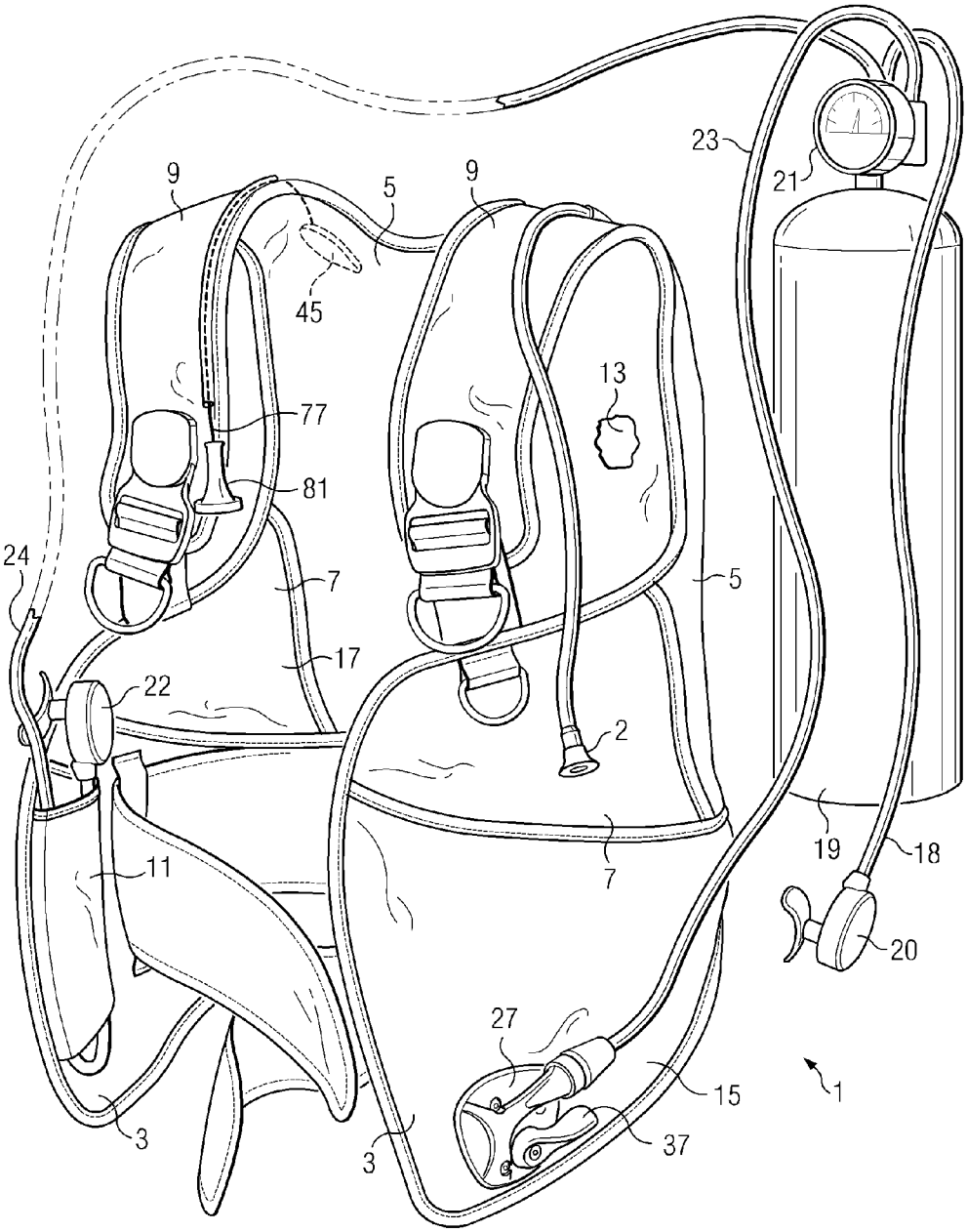
FIG. 2*a* is a front perspective view of a typical buoyancy compensation vest and an exterior view of the invention attached thereto.
Figure 2B:
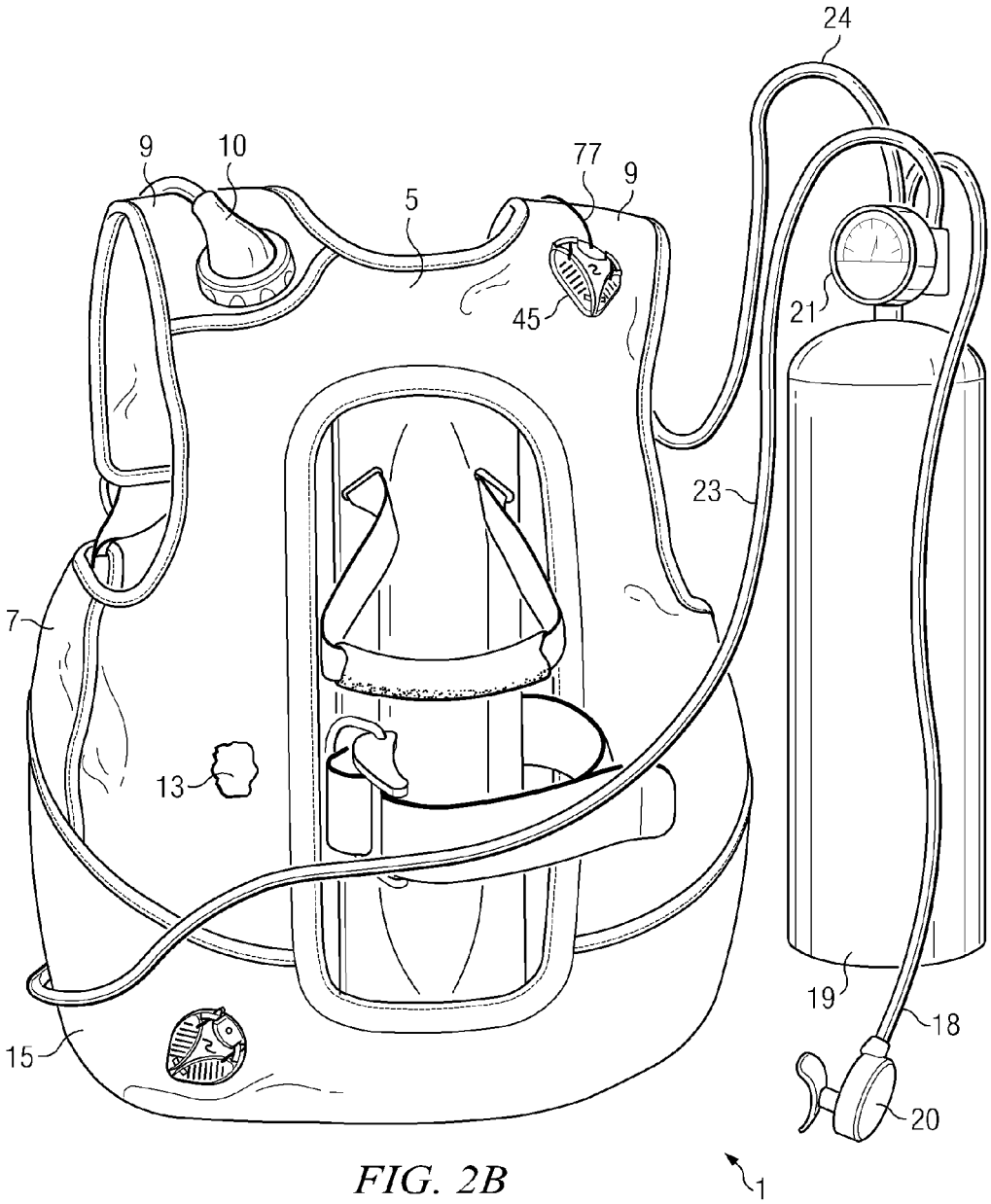
FIG. 2*b* is a back perspective view of a typical buoyancy compensation vest and an exterior view of the invention attached thereto.

FIGS. 2*a* and 2*b* shows diver's vest 1 having interconnected front panels 3, rear panel 5, two side panels 7 and shoulder panels 9 that fit together along their respective boundaries around the diver's torso (not shown). At least one gas-tight compartment 13 is formed between the outside vest wall 15 and the inside vest wall 17 adapted to retain therein a gas, such as compressed air or mixtures of oxygen-containing gas with other gas diluents, generally received from a gas supply tank 19, throttled through a gas pressure reducer 21, carried by the diver, and delivered by a hose 23. Vest 1 has a means for mounting and securing gas supply tank 19. Typically, gas pressure reducer 21 has multiple ports for delivering gas to other components, such as breathing regulators and accessories such as a buoyancy compensation device. In addition to primary hose 18 and primary regulator 20 used by the diver, spare hose 24 and spare regulator 22, collectively called an octopus, can be used as an emergency back-up.

To conveniently secure the octopus, vertically oriented, open ended cloth sleeve 11 is affixed to inside vest front panel 3. Cloth sleeve 11 is approximately three-and-one-half inches wide and six inches high. Cloth sleeve 11 is adapted to hold a folded portion of spare hose 24 of the octopus, with the folded end of hose 24 at the bottom end of sleeve 11 and spare regulator 22 positioned at the top of sleeve 11. Sleeve 11 keeps spare regulator 22 in a convenient location where it will not snag on extraneous elements, and will not interfere with the diver's activities. When a second diver needs to access the octopus, the second diver can reach inside vest front panel 3, grasp spare regulator 22, and pull the octopus hose from sleeve 11.

Figure 3:
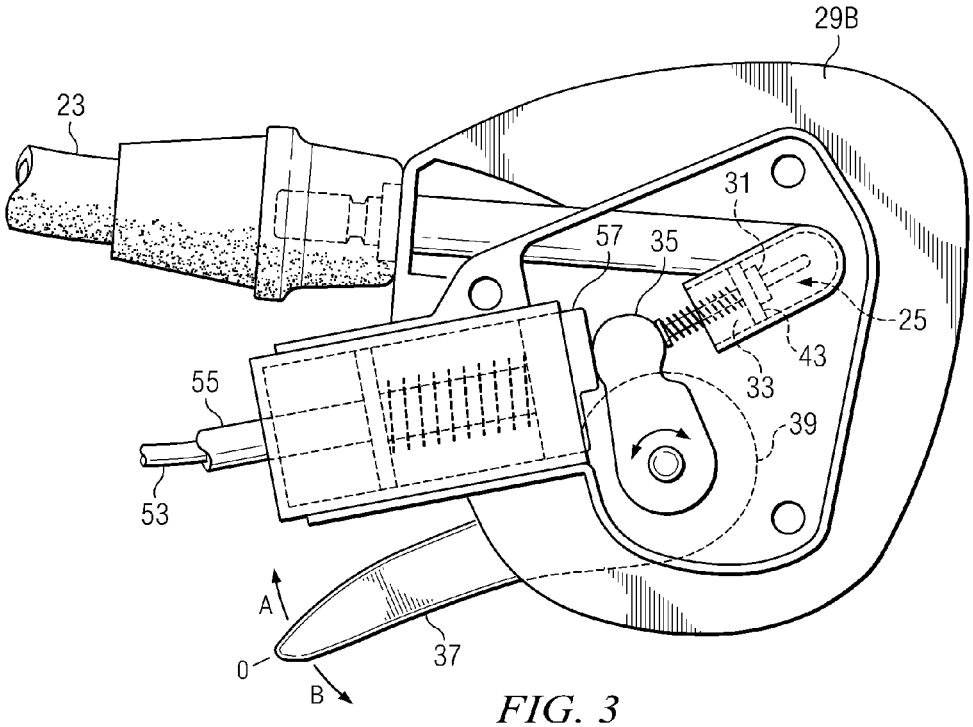
FIG. 3 is a section view of the assembled inflation valve housing.
Figure 4:
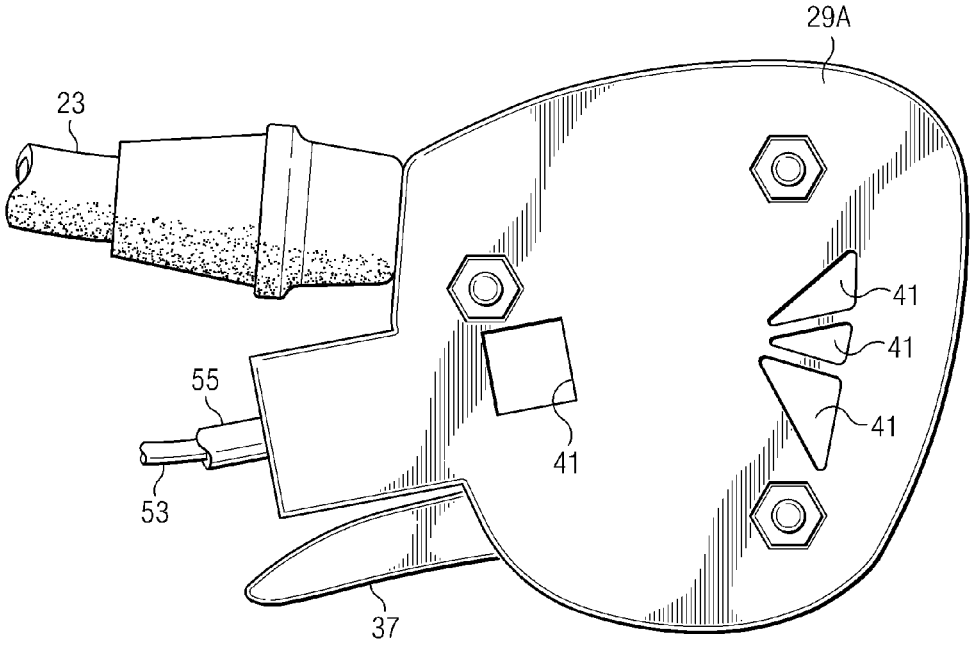
FIG. 4 is a bottom view of the outside of the assembled inflation valve housing.

As generally shown in FIGS. 2*a*, 2*b*, 3, and 4, the buoyancy adjustment device of this invention comprises an inflation valve 25, mounted inside an assembled inflation valve housing 27, comprising a pair of housing halves 29*a* and 29*b*. Inflation valve 25 and assembled inflation valve housing 27 is mounted substantially within compartment 13, adjacent to outside vest wall 15. Inflation valve 25 is connected to gas supply tank 19, or more preferably to gas pressure reducer 21 through a hose 23. When opened, inflation valve 25 admits pressurized gas from hose 23 into gas-tight compartment 13. In a preferred embodiment, inflation valve 25 admits pressurized gas from hose 23 into assembled inflation valve housing 27, which is in flow communication with gas-tight compartment 13. As shown in FIGS. 3 and 4, inflation valve 25 is a standard SCHRADER® pneumatic valve, with spring-loaded inflation valve plug 31, adapted for sliding movement in an inflation valve passageway 33, and adapted to open and close by action of a cam 35 activated by a lever 37. Biasing elements other than a spring may be used with inflation valve plug 31.

Referring to FIG. 3, lever 37 is adapted to be pivoted about lever end 39 preferably by action of the diver's hand from a neutral position "0" through a first positive arc "A", as shown in FIG. 2, against spring pressure from spring-loaded inflation valve plug 31. Such pivoting of lever 37, into a first position, moves inflation valve 25 from a closed position to an open position in passageway 33 to allow gas from gas supply tank 19 through hose 23 and into compartment 13 through valve housing openings 41 to inflate gas-tight compartment 13. An inflation valve seat 43 is provided with inflation valve plug 31 and is spring-loaded closed when lever 37 is in its neutral "0" position, or has been moved to the opposite side of the "0" position from arc "A" to seal compartment 13 against gas leakage through inflation valve 25. Release of lever 37 results the in spring pressure from spring-loaded inflation valve plug 31 to pivot lever 37 back to neutral position "0", sealing inflation valve plug 31 against inflation valve seat 43 in passageway 33, and shutting off the gas supply from tank 19. Although a cam and lever system is shown in FIG. 3 to activate inflation valve 25, other controllers such as a toggle switch, joy stick, or sliding switch may be used to activate inflation valve 25.

Figure 5:
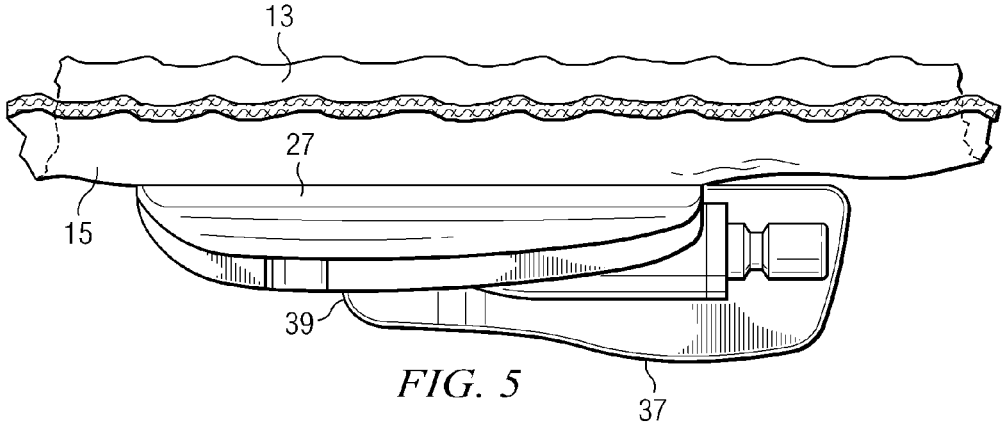
FIG. 5 is a side illustrative view of the exterior of the inflation valve assembly.

Inflation valve housing half 29*a*, first spring-loaded valve plug 31, inflation valve passageway 33, cam 35, and inflation valve seat 43 are located almost completely inside gastight compartment 13. Pivotable lever 37 extends outside vest wall 15. The connection between hose 23 and inflation valve 25, and housing half 29*b* reside outside compartment 13 and above outside vest wall 15 in a low profile silhouette, as shown in FIG. 5.

FIGS. 6, 7, 8, and 9 show exhaust valve 45, mounted inside an assembled housing comprising exhaust valve lower housing 47 and exhaust valve upper housing 69. Exhaust valve 45 is generally located in a remote position from inflation valve 25. Exhaust valve 45 is located substantially within compartment 13 adjacent to outside vest wall 15, and arranged to exhaust gas from gas-tight compartment 13 to the outside environment surrounding vest 1. Exhaust valve 45 includes a spring-loaded exhaust valve plate 49, adapted for sliding movement in an exhaust valve passageway 51 to open and close by action of a flexible push rod 53 slidingly mounted inside a sheath 55. Push rod 53 is terminated, at one end, by slidable cam follower 57 that rides against cam 35 in inflation valve housing half 29*a* (shown in FIGS. 3 and 4) and, at the other end, bottoms against exhaust valve plate 49. Pliable valve gasket 59 is fitted to the end of spring-loaded exhaust valve plate 49 for bearing against sealing surface 61. Gas is exhausted from inside compartment 13 through openings 67 formed in exhaust valve upper housing 69 mounted on the upper portion of exhaust valve lower housing 47. Biasing elements other than spring 48 may be used with exhaust valve plate 49

Figure 9:
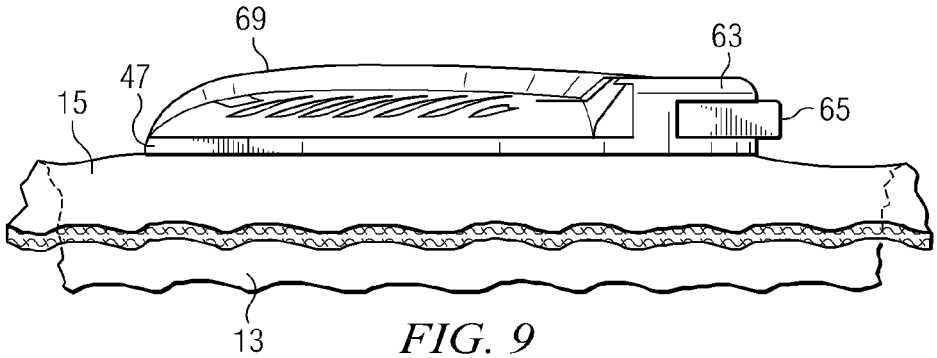
FIG. 9 is a side illustrative view of the exterior of the exhaust valve assembly.

The sliding movement of exhaust valve plate 49 in exhaust valve passageway 51 is substantially parallel to outside vest wall 15. This lateral movement allows valve 45 to maintain a low profile with respect to outside vest wall 15. Prior art exhaust valves open with a substantially perpendicular movement with respect to outside vest wall 15, requiring a prominent housing mounted outside of compartment 13, above outside vest wall 15. To facilitate the substantially planar configuration, exhaust valve 45 uses an integrated quick release buckle comprising clips 65 and locking mechanism 63 to lockingly engage exhaust valve upper housing 69 to exhaust valve lower housing 47 in a sliding motion substantially parallel to outside vest wall 15. With the present configuration, only planar cover 69 and locking mechanism 63 of exhaust valve lower housing 47 extend above outside vest wall 15 as shown by FIG. 9.

Figure 7:
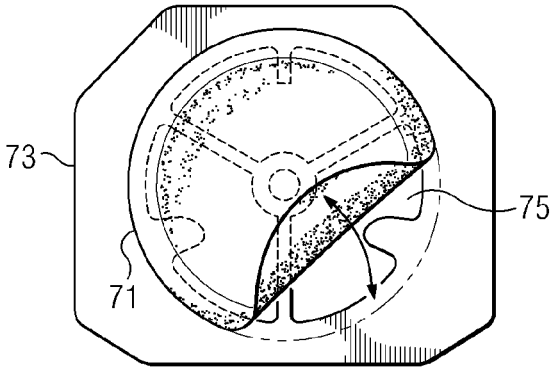
FIG. 7 is a top view of the exhaust valve assembly flap plate.
Figure 8:
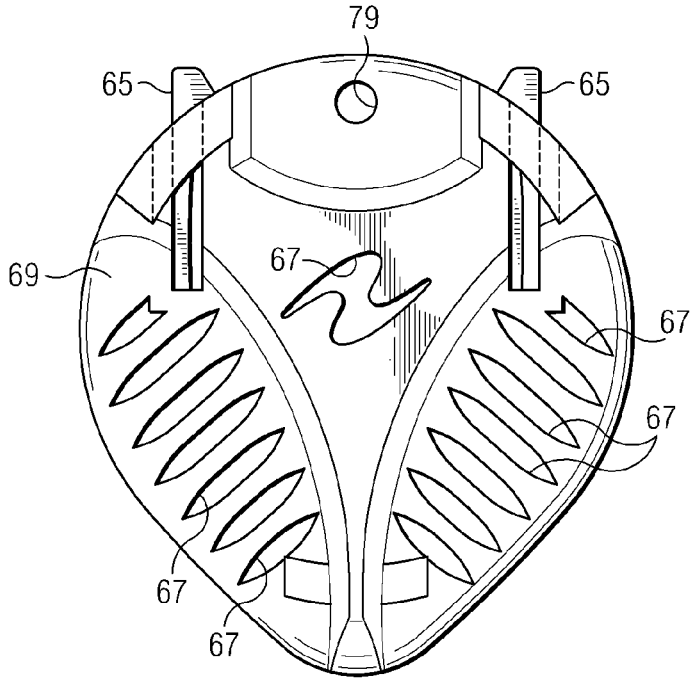
FIG. 8 is a top view of the exhaust valve housing cover plate.

Soft, rubber flap 71 is centrally mounted on a flap plate 73 as shown in FIG. 7. Flap plate is assembled between exhaust valve upper housing 69 and exhaust valve lower housing 47. Rubber flap 71 and is adapted to deform under escaping gas pressure and allow the escaping gas to dribble from under the pliant outer circumferential area of flap 71. The use of a pliant rubber flap is known in the art to reduce back flow of water from entering compartment 13 through opened exhaust valve 45.

Figure 6:
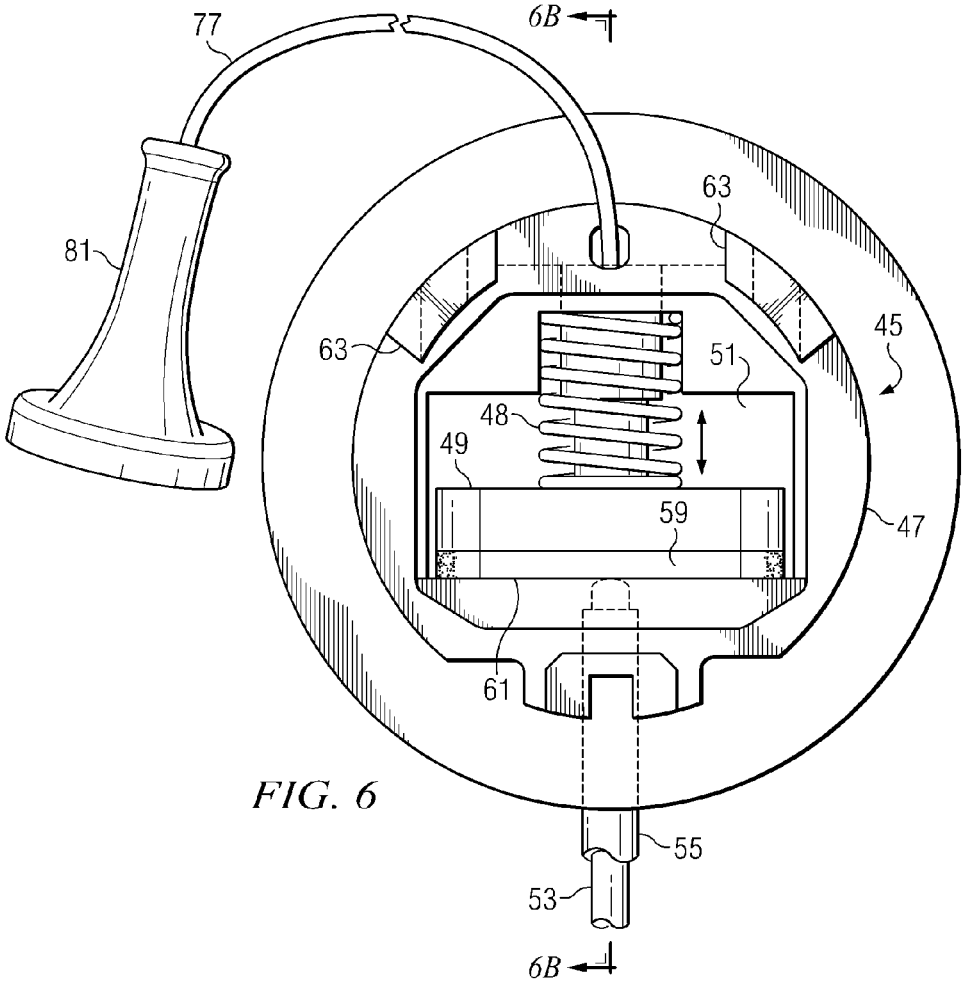
FIG. 6 is a top view of the inside of the exhaust valve assembly.
Figure 6A:
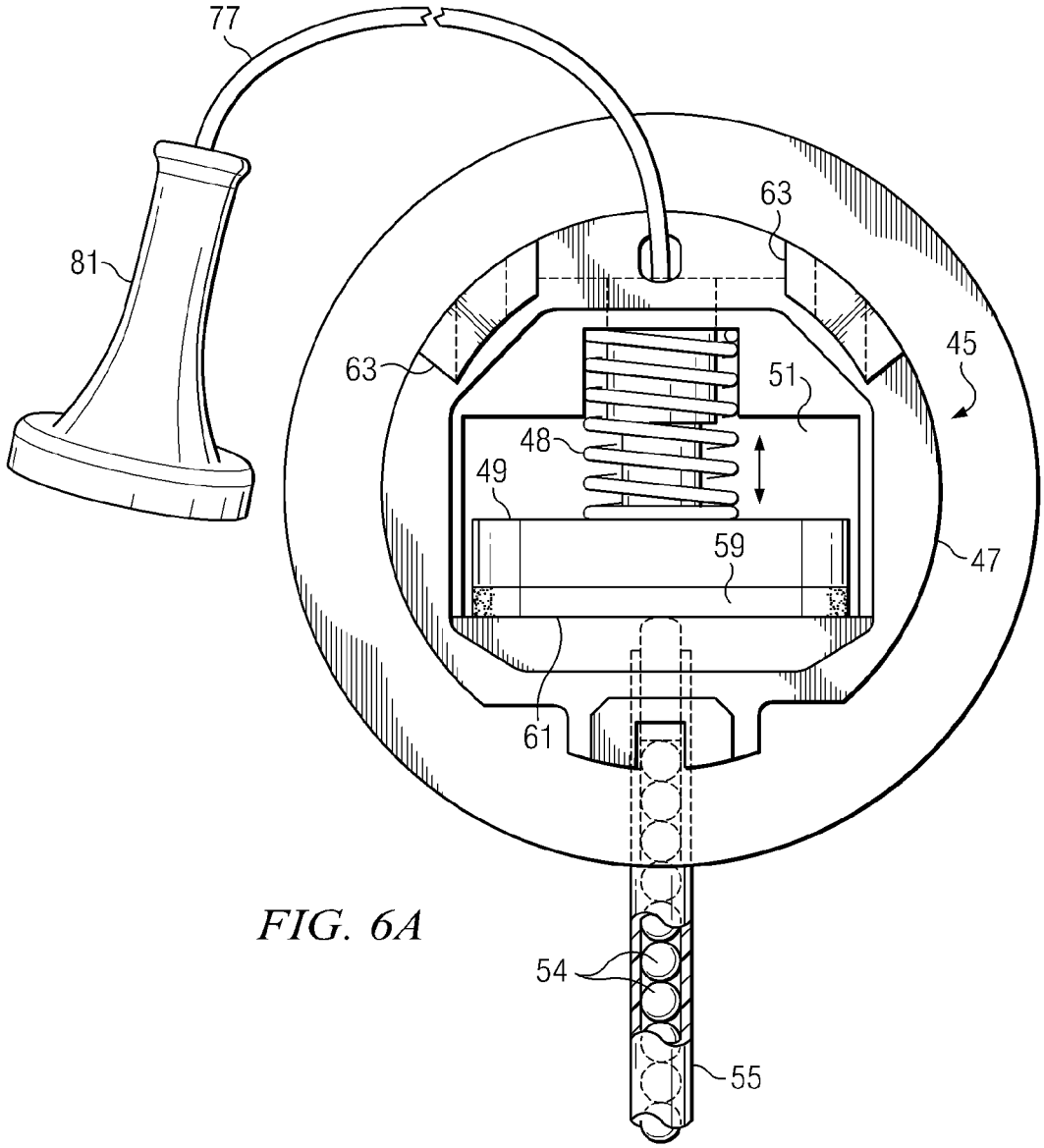
FIG. 6A is an alternate embodiment of the inside of the exhaust valve assembly showing the flexible push rod being comprised of beads.
Figure 6B:
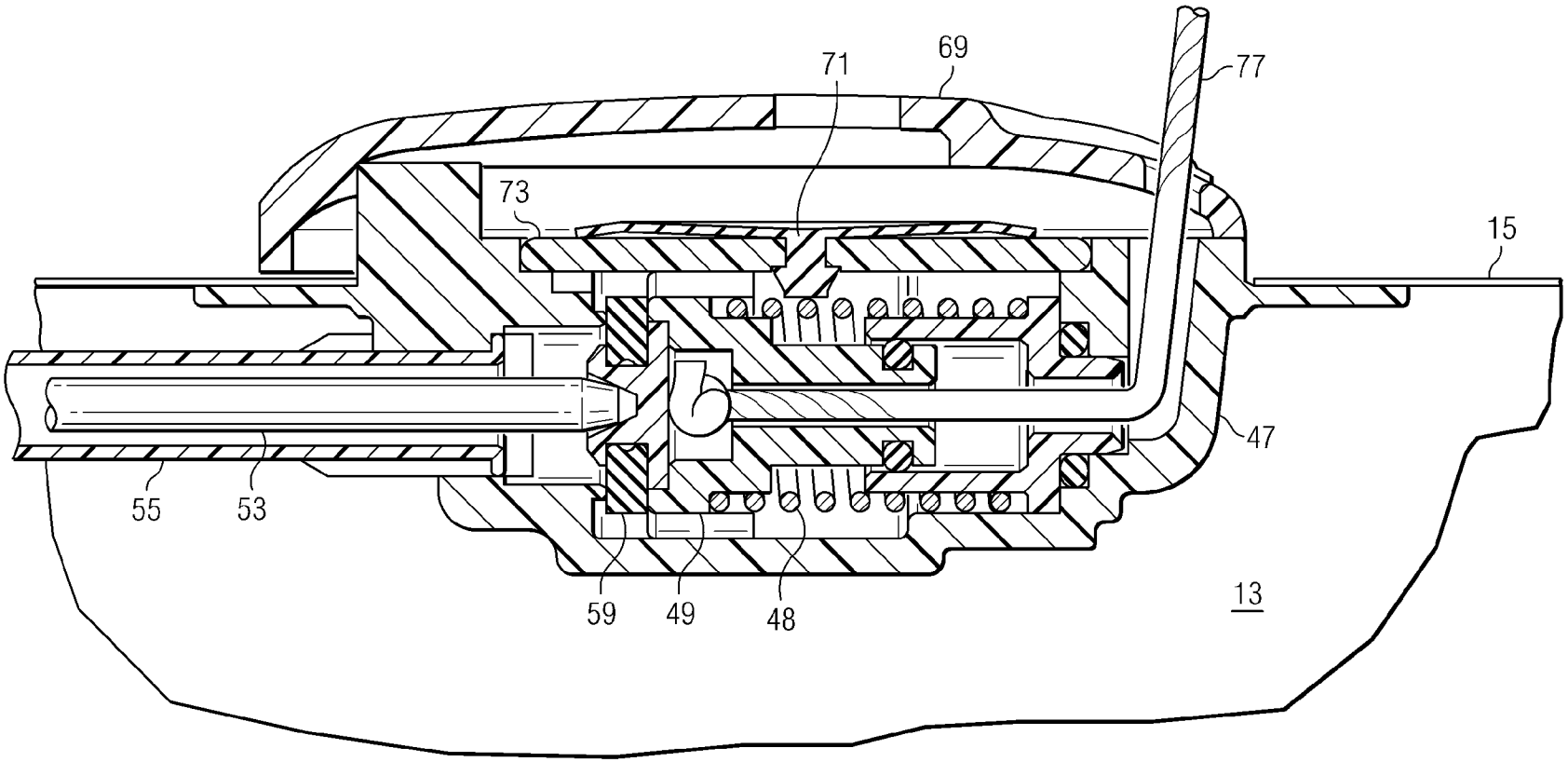
FIG. 6B is a cross section of the exhaust valve along the line 6B in FIG. 6.

When lever 37, as shown in FIG. 3, is moved in an arc "B", on the opposite side of neutral position "0" from arc "A", cam 35 moves against cam follower 57 and forces push rod 53 under compression against cam follower 57. Push rod 53, as shown in FIG. 6, moves exhaust valve plate 49 and opens exhaust valve 45 and exhausts gas from inside compartment 13 out through openings 75 under flap 71 and through openings 67 into the surrounding environment. Although a cam and lever system is shown in FIG. 3 to activate push rod 53 and exhaust valve 45, other controllers such as a toggle switch, joy stick, or sliding switch may be used to activate exhaust valve 45.

As shown in FIGS. 3 and 6, pivotable lever 37 is connected to remote, exhaust valve 45 by a solid, flexible push rod 53 slidingly housed in a tight-fitting, flexible sleeve or sheath 55 and subject only to compression loads as lever 37 is rotated from its neutral position "0" through its arc "B" and against the compressive force of spring-loaded exhaust valve plate 49. Push rod 53 and covering sheath 55 lie wholly inside compartment 13 to place them out of possible contact with ropes, wires, tree limbs, grasses, and other extraneous items commonly found under water. Compressing a solid rod in a tight-fitting plastic sleeve provides far less chance of rod failure than pulling on a multistrand cable, and provides immunity to common problems of corrosion commonly found therein. The compressive force of spring-loaded exhaust valve plate 49 causes lever 37, when released, to pivot back from arc "B" to neutral position "0" sealing exhaust valve plate 49 against a sealing surface 61 stopping the exhaustion of gas from inside compartment 13 into the outside environment. Because pushrod 53 is only subject to compressive forces, pushrod 53 can be constructed from a series of short rods or beads placed inside sheath 55 to enhance flexibility.

As shown in FIG. 3, this unique design establishes lever 37 in a neutral position "0" by the offsetting pressures of first spring-loaded valve plug 31 and second spring-loaded exhaust valve plate 49. Movement of lever 37 in one direction from neutral opens an inflation valve and allows an exhaust valve to remain closed under spring pressure. When lever 37 is moved in the other direction from its neutral position the inflation valve remains closed while the exhaust valve is opened. Lever 37 is easy to manipulate, even when the diver's hands are holding tools, or when fingers are stiff due to cold water. Further, as shown in FIG. 2*a*, lever 37 is preferably located low and to one side of vest 1 on one of side panels 3 to keep it out of interference with the diver as he or she uses their hands and arms in front of their body. Although the hand controller is shown here as a lever, other controllers having a neutral position, and two or more activation positions such as a toggle switch, joy stick, or sliding switch may be used to activate the valves. The controller having more than two activation positions may be adapted to control other functions on the vest in addition to inflating and deflating the compartment.

As shown in FIGS. 2*b* and 6, lanyard 77 is mounted in exhaust valve 45 and attached to the opposite end of exhaust valve plate 49 from pliable gasket 59. Lanyard 77 passes from exhaust valve plate 49 out of exhaust valve lower housing 47, preferably through a guide 79 and beyond. Lanyard 77 may be terminated with bulbous, graspable end piece 81 for use by the diver to grasp and pull to override the spring bias of exhaust valve plate 49 to release gas from compartment 13 into the surrounding environment. This is a failsafe feature that provides emergency deflation to vest 1 when desired.

Inflation valve 25, exhaust valve 45, lever 37 and their internal components are preferably made of molded, inert plastic, such as polycarbonate, polystyrene, and the like. These materials are generally immune to dimensional changes due to water temperatures and are generally unaffected by the acidity, the alkalinity, or salt content of the water. The springs on first and second spring-loaded valve plugs 31 and exhaust valve plate 49 may be made of stainless steel to resist corrosion. Additionally, exhaust valve plate 49 is adapted to automatically release gas from compartment 13 if over inflation occurs to prevent damage to the bladder comprising compartment 13. Pliable gasket 65 is preferably made from materials already used in the diving industry such as ethylene propylene diene monomer (EPDM) rubber. Push rod 53 can be made of plastic and plastic mixtures that display flexibility and inertness in the waters in which the vests are used. Lanyard 77 may be made of a variety of materials that stand up to the effects of water and can take the stress of pulling to open exhaust valve 45 against the opposing pressure of spring-loaded exhaust valve plate 49.

A preferred form of the invention has been shown in the drawings and described above, but variations in the preferred form will be apparent to those skilled in the art. The preceding description is for illustration purposes only, and the invention should not be construed as limited to the specific form shown and described. Specifically, lever 37 can be replaced with push buttons that cause rotation of cam 35, controlling the valves, or with other controllers such as a toggle switch, joy stick, or sliding switch. A controller having more than two activation positions may be adapted to control other functions on the vest in addition to inflating and deflating the compartment. Although the exhaust valve assembly is shown and described in a remote location from the inflation valve assembly, the inflation valve and exhaust valve assemblies may be positioned adjacent to each other, or even within the same housing separated by an airtight divider. Additionally, multiple exhaust valves and valve assemblies may be operated with push rods in the same manner as described for exhaust valve 45. The scope of the invention should be limited only by the language of the following claims.

What is claimed is:

1. An exhaust valve assembly for a buoyancy compensating device comprising:

a lower housing;

an upper housing substantially covering the lower housing;

at least one vent in the upper housing, open to a surrounding environment;

an opening into the buoyancy compartment through a first end of the lower housing;

a biasing element affixed to a second end of the lower housing, opposite the opening;

a valve plate having a first side adapted to cover the opening and a second side adapted to engage the biasing element;

a gasket on the first side of the valve plate adapted to seal the opening with pressure applied to the second side of the valve plate by the biasing element;

a passageway through the lower housing adapted to allow the valve plate to slide from a closed position with the gasket sealed against the opening to an open position with the gasket distant from the opening;

wherein movement of the valve plate is approximately parallel to a plane defined by an outer surface of the buoyancy compartment surrounding the lower housing.

2. The exhaust valve assembly of claim 1 wherein the gasket, biasing element, and valve plate are located substantially within the buoyancy compartment.

3. The exhaust valve assembly of claim 2 wherein a lanyard has a first end affixed to the valve plate and a second end affixed to an end piece located outside the upper housing; wherein pulling on the end piece causes the valve plate to slide against the biasing element to activate the valve.

4. An exhaust valve assembly for a buoyancy compensating device comprising:

a lower housing;

an upper housing substantially covering the lower housing;

at least one vent in the upper housing open to a surrounding environment;

an opening into the buoyancy compartment through a first end of the lower housing;

a biasing element affixed to a second end of the lower housing, opposite the opening;

a valve plate having a first side adapted to cover the opening and a second side adapted to engage the biasing element;

a gasket on the first side of the valve plate adapted to seal the opening with a pressure applied to the second side of the valve plate by the biasing element;

a passageway through the lower housing adapted to allow the valve plate to slide from a closed position with the gasket sealed against the opening to an open position with the gasket distant from the opening;

wherein the opening into the buoyancy compartment through the first end of the lower housing is located below a plane defined by an outer surface of the buoyancy compartment surrounding the lower housing.

5. The exhaust valve assembly of claim 4 wherein the gasket, biasing element and valve plate are located substantially within the buoyancy compartment.

6. The exhaust valve assembly of claim 5 wherein the movement of the valve plate is approximately parallel to the plane described by the outer surface of the buoyancy compartment surrounding the lower housing.

7. The exhaust valve assembly of claim 6 wherein a lanyard has a first end affixed to the valve plate and a second end affixed to an end piece located outside the upper housing; wherein pulling on the end piece cause the valve plate to slide against the biasing element to activate the valve.

8. A valve assembly for a buoyancy compensation device comprising:

a lower housing affixed to a buoyancy compartment;

a valve mechanism within the lower housing adapted to release a gas from the buoyancy compartment;

an upper housing covering the lower housing;

at least one vent in the upper housing, open to a surrounding environment;

a quick release buckle integrated with the upper housing adapted to lockingly engage the upper housing to the lower housing.

9. The valve assembly of claim 8 wherein the integrated quick release buckle of the upper housing is adapted to engage the lower housing in a sliding motion approximately parallel to a plane defined by an outer surface of the buoyancy compartment surrounding the lower housing.

10. An exhaust valve assembly for a buoyancy compensating device comprising:

a lower housing;

an opening into a buoyancy compartment through a first end of the lower housing;

an upper housing substantially covering the lower housing wherein the upper housing includes an exposed portion above the buoyancy compartment;

at least one vent in the upper housing, open to a surrounding environment;

a biasing element affixed to a second end of the lower housing, opposite the opening;

a valve plate having a first side adapted to cover the opening and a second side adapted to engage the biasing element;

a gasket on the first side of the valve plate adapted to seal the opening with the pressure applied to the second side of the valve plate by the biasing element;

a passageway through the lower housing adapted to allow the valve plate to slide from a closed position with the gasket sealed against the opening to an open position with the gasket distant from the opening; and wherein the exposed portion of the upper housing has a low profile.

11. An exhaust valve assembly for a buoyancy compensating device comprising:

a lower housing;

an opening into a buoyancy compartment through a first end of the lower housing;

an upper housing substantially covering the lower housing wherein the upper housing includes an exposed portion above the buoyancy compartment;

at least one vent in the upper housing, open to a surrounding environment;

a biasing element affixed to a second end of the lower housing, opposite the opening;

a valve plate having a first side adapted to cover the opening and a second side adapted to engage the biasing element;

a gasket on the first side of the valve plate adapted to seal the opening with the pressure applied to the second side of the valve plate by the biasing element;

a passageway through the lower housing adapted to allow the valve plate to slide from a closed position with the gasket sealed against the opening to an open position with the gasket distant from the opening;

wherein the exposed portion of the upper housing is substantially planar with the outer surface of the buoyancy compartment.

* * * * *